US012799747B2

(12) United States Patent
Toca et al.

(10) Patent No.: US 12,799,747 B2
(45) Date of Patent: Nov. 17, 2026

(54) MICROPOINT STRUCTURES FOR TILE EDGE SPACING

(71) Applicant: DTM INNOVATIONS LLC, Metairie, LA (US)

(72) Inventors: Roland Toca, New Orleans, LA (US); Michele Volponi, Metairie, LA (US); Darrin Godbold, Metairie, LA (US)

(73) Assignee: DTM INNOVATIONS LLC, Metairie, LA (US)

( * ) Notice: Subject to any disclaimer, the term of this patent is extended or adjusted under 35 U.S.C. 154(b) by 194 days.

(21) Appl. No.: 18/534,039

(22) Filed: Dec. 8, 2023

(65) Prior Publication Data

US 2024/0110393 A1 Apr. 4, 2024

Related U.S. Application Data

(63) Continuation-in-part of application No. 17/824,761, filed on May 25, 2022, now Pat. No. 11,840,852.

(51) Int. Cl.
*E04F 21/00* (2006.01)

(52) U.S. Cl.
CPC ..... *E04F 21/0092* (2013.01)

(58) Field of Classification Search
CPC .... E04F 21/22; E04F 21/0092; E04F 21/1877
See application file for complete search history.

(56) References Cited

U.S. PATENT DOCUMENTS 5,675,942 A * 10/1997 Crawford ..... E04F 21/18 52/509
7,861,487 B2 1/2011 Kufner et al.
(Continued)

FOREIGN PATENT DOCUMENTS

EP 2549030 A2 11/2014
ES 2927004 T3 10/2022
(Continued)

OTHER PUBLICATIONS

Rubi, "New Delta Level System," https://www.rubi.com/en/blog/new-delta-level-system-small-improvements-that-make-a-good-product-great/ (last accessed May 25, 2022).
(Continued)

*Primary Examiner* — Babajide A Demuren
(74) *Attorney, Agent, or Firm* — KEATY LAW FIRM LLC; Thomas S. Keaty

(57) ABSTRACT

A micropoint structures for tile edge spacing system and method for use with tiles set with mortar as floors or walls on prepared surfaces, providing spacing tabs having micropoint structures, where the spacing tabs can be used as components of lippage-control units or be used or reused as auxiliary or standalone spacers. Each micropoint structure protrudes from a face of the spacing tab and has a contact area at an extreme point. Each micropoint structure has a corresponding micropoint structure on the opposite face of the spacing tab, and the distance between the contact areas of corresponding micropoint structures controls the spacing of the gap or grout line between the installed tiles. The configuration and placement of the micropoint structures provide proper setting of the gap between tiles at the top edges, avoiding spacing problems caused by irregular tile side surfaces or irregular underlayment, and provide for avoidance of becoming bound or blocked by the set mortar or tiles which could cause difficulty during removal and cause damage to the set tiles. The micropoint structures are provided in several embodiments each having a small contact area at an extreme point and a tapering or decreasing profile away from the contact area.

11 Claims, 5 Drawing Sheets

(56) References Cited

U.S. PATENT DOCUMENTS

| | | | | |
|---|---|---|---|---|
| 7,992,354 | B2 | 8/2011 | Doda, Jr. | |
| 8,079,199 | B1 | 12/2011 | Kufner et al. | |
| 8,181,420 | B2 | 5/2012 | Torrents I Comas | |
| 8,429,878 | B1 | 4/2013 | Hoffman et al. | |
| 8,429,879 | B1 * | 4/2013 | Hoffman | E04F 21/0092 52/747.11 |
| 8,689,522 | B2 | 4/2014 | Hoffman et al. | |
| 8,820,031 | B2 | 9/2014 | Kufner et al. | |
| 8,966,835 | B1 | 3/2015 | Hoffman et al. | |
| 9,027,308 | B2 | 5/2015 | Kufner et al. | |
| 9,279,259 | B1 | 3/2016 | Russo | |
| D760,566 | S * | 7/2016 | Biec | D8/47 |
| 9,470,002 | B2 | 10/2016 | Irvine et al. | |
| 9,482,019 | B2 | 11/2016 | Fontana | |
| 9,657,485 | B2 | 5/2017 | Meyers | |
| D820,059 | S * | 6/2018 | Biec | E04F 21/22 D8/47 |
| 10,465,394 | B2 | 11/2019 | Sighinolfi | |
| 10,577,813 | B2 | 3/2020 | Dahill | |
| 10,604,945 | B2 | 3/2020 | Volponi et al. | |
| 10,704,275 | B2 | 7/2020 | Bunch et al. | |
| 10,724,254 | B1 | 7/2020 | Troxell | |
| 10,822,813 | B1 | 11/2020 | Bunch et al. | |
| 11,105,102 | B2 | 8/2021 | Bunch et al. | |
| 2015/0308130 | A1 * | 10/2015 | Biec | E04F 21/0092 52/749.11 |
| 2018/0291640 | A1 | 10/2018 | Sighinolfi | |
| 2018/0355623 | A1 | 12/2018 | Frisco | |
| 2019/0093372 | A1 | 3/2019 | Russo | |
| 2019/0169863 | A1 | 6/2019 | Torrents Comas | |
| 2020/0347617 | A1 | 11/2020 | Troxell | |
| 2021/0062522 | A1 | 3/2021 | Castellanos | |
| 2021/0131124 | A1 | 5/2021 | Bunch et al. | |
| 2024/0360683 | A1 * | 10/2024 | Toca | E04F 21/0092 |

FOREIGN PATENT DOCUMENTS

| | | | |
|---|---|---|---|
| ES | 2932835 | T3 | 1/2023 |
| WO | WO2018052331 | A1 | 3/2018 |

OTHER PUBLICATIONS

MLT Mechanical Lippage Tuning System, https://www.mltsystem.it/en/ (last accessed May 25, 2022).

YouTube, "Spin Doctor Tile Leveling System: Wall & Floor Installation," https://www.youtube.com/watch?v=NwP1OW1-7L0 (last accessed May 25, 2022).

YouTube, "QEP's LASH Tile Leveling System | The Home Depot," https://www.youtube.com/watch?v=PUBAnbAm3Al (last accessed May 25, 2022).

YouTube, "Tuscan SeamClip Tile Leveling System by Pearl," https://www.youtube.com/watch?v=J-_Ngy8AyxE (last accessed May 25, 2022).

YouTube, "How to use Tile Leveling Clips by Peygran," https://www.youtube.com/watch?v=k90kRglqSZI (last accessed May 25, 2022).

* cited by examiner

MICROPOINT STRUCTURES FOR TILE EDGE SPACING

CROSS-REFERENCE TO RELATED APPLICATION

This application is a continuation-in-part of co-pending application Ser. No. 17/824,761, filed on May 25, 2022, the full disclosure of which is incorporated by reference herein and priority of which is hereby claimed.

BACKGROUND OF THE INVENTION

This invention provides a micropoint structures for tile edge spacing system and method for use with tiles set with mortar as floors or walls on prepared surfaces.

When setting tiles such as gauged porcelain tiles, panels, or slabs, or the equivalent stones or slate, lippage, or the variations in the level of the tops of the edges of the tiles after installation, is a problem of great concern. Variations of lippage or level can be visually unacceptable, as with shadows cast on walls having strong downward, upward, or side lighting. Variation of lippage or level on floors can be dangerous as tripping hazards and as areas prone to further damage by striking raised edges.

Tile installations are tending toward larger tiles and smaller grout lines, both of which can compound lippage problems. The ANSI A108.19 standard for tile installation requires a lippage control system where any dimension of the tiles is one meter or greater. The maximum allowable lippage is 1/32 inch.

Lippage control devices place compressive force on the top edges and bottom edges of adjacent tiles and force the top edges to align while accommodating variations in thickness at the bottom edges. The bottom surfaces of the tiles, including at the edges and including any lippage control device underneath the tiles, must be covered with and supported by mortar. Lippage control devices necessarily extend through the grout joint between adjacent tiles.

After the mortar has set, any parts of the lippage control device which extends up through the grout joint to the top surface of the tiles must be removed. It is undesirable to leave any scraps from the device in the grout joint, and unacceptable to leave any scraps at or near the surface of the grout. A common method for removing such parts of the lippage control device after the tiles are set is to laterally strike the parts. The striking can be done with a tool, such as a non-marking rubber mallet, but is often done with the more readily available work boot. This removal method carries a great risk of damage to the installed tile, which will frequently require cumbersome and expensive removal of damaged tile and replacement with an exactly matching tile. Many present lippage control devices either possess design features which allow the parts to become pinched or bound or blocked within the grout joint, making removal difficult and increasing the chance of damage, or features which require more cumbersome removal procedures than simply striking, sometimes requiring special tools and significant time spent on each removal.

The ANSI A108.19 standard currently recommends that any lower part of any lippage control device which remains underneath the tiles after installation should be encapsulated with mortar. This encapsulation with mortar builds up mortar at the base of any lippage control device, and that mortar, when cured and set, can bind or block the lower parts of the device and interfere with clean removal without damage.

The smallest or thinnest grout joint allowed by the ANSI standard is 1/16" or 0.8 mm. Such a thin grout line is used in many installations. Presently known lippage control devices which have a thickness or depth in excess of 1/16" prevent installations having thinner grout lines. Although presently known lippage control devices are not necessarily designed to be used as spacers, they are often manufactured and used as spacers anyway, and are likely to become pinched or bound between the tile edges, requiring excessive force, digging, or cutting to remove, increasing likelihood of damage to the installed tiles.

U.S. Pat. No. 8,966,835 for a "Reusable Shim Shell Mechanical Edge Setting System and Method for Setting Tiles and Tuning Lippage," issued on Mar. 3, 2015 to assignee New Standards Manufacturing Co., provides for a tile aligning and lippage tuning system that uses an under tile base interstitial strap, which is connected to said under tile base, and a shim shell cap configured to slip over the connecting tab. The system also comprises of a bottom tile mating shim and a top shim.

U.S. Pat. No. 9,482,019 for a "Leveling Device for Laying Tiles or the Like," issued on Nov. 1, 2016 to assignee PROFILITEC S.P.A. SOCIO UNICO, provides for a leveling device for laying tiles, or the like, which includes a tie-rod having a support base for edge portions of one or more adjacent tiles, a projecting element from the base, which can be arranged into junctions between adjacent tiles, and a knob coupling with the projecting element and having an outlet pass-through hole for a free end of the projecting element. The knob is configured to force an edge portion of the adjacent tiles against the base to level the placement and is configured to receive and retain, by snap coupling elements, a blocking tie-rod hooking and retaining the projecting element inside a pass-through channel defined in the blocking tie-rod. The blocking tie-rod is sectioned into two coupling half-shells, embracing and constraining the projecting element when inserted in the cap, and mutually separating to leave free the projecting element when at least partially extracted from the cap.

International Publication No. 2018/052331 for a "Tile-Levelling System," published on Mar. 22, 2018 by inventor Aleksandar Jelie, discloses a tile levelling system that enables the tiling of floors, walls, and ceilings so that the resulting surface is completely flat and lippage free. The system comprises a base plate with a vertical member, which has a rectangular opening perpendicular to the base plate, and two opposite longitudinal grooves, which are V-shaped in cross section, placed below the rectangular opening on the vertical member. The upper surface of the base plate is flat. The lower surface of the base plate is corrugated with parallel ridges. Between these ridges are grooves, which ensure better adhesion of either adhesive or aggregate to the very base plate, thus making the entire construction stronger.

European Patent No. 2 549 030 for a "A Device for Correct Laying of Floor Tiles," issued on Nov. 12, 2014 to assignee Brunoplast di Eleuteri Bruno, provides for a plastic device for correct laying of floor tiles, and the device comprises of a base from which a vertical blade centrally protrudes, supporting a threaded stem in upper position and being connected on the bottom with said base by means of a lower end with thinned section suitable to act as tearing line. The device also comprises of a knob, consisting in a cylindrical cover, starting from its upper closing wall, with a central cylindrical conduit with internal threaded walls, adapted to exactly receive, by means of a helical coupling, said threaded stem provided in upper position on said base.

U.S. Pat. No. 8,181,420 for a "Levelling Device for the Placing of Pieces for Covering Floors and Similar," issued on May 22, 2012 to assignee Germans Boada, S.A., provides for a device that has a first lower substantially flat body, which has in its upper part a flexible post with a narrowed or weakened portion and a second upper body with the passage for receiving and securing said post. The flexible post, which has a rectangular cross section, has in its main surfaces respective mutually opposed "teeth" which are offset in the lengthwise direction and the passage of the second body has two latching pawls mutually opposed, so that in the operative position of the devices, the teeth of the flexible post engage in an alternate form with said latching pawls. The second body has a bell like hollow form with a lower widened contact mouth or border.

U.S. Pat. No. 8,079,199 for a "Tile Alignment and Leveling Device," issued on Dec. 20, 2011 to assignee Davinci Italia/USA Group, LLC, provides for a device for aligning and leveling tiles as they are laid in floors, walls, countertops, or the like. The device has a locking assembly and a bottom plate. The components are combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries.

U.S. Pat. No. 9,657,485 for a "Tile Leveling System," issued on May 23, 2017 to inventor Lawrence G. Meyers, provides for a tile leveling system that includes an anchor member arranged to be positioned in a setting bed below adjacent tiles. A tensioning member extends upwardly from the anchor member and is arranged to pass between the adjacent tiles. The tensioning member is made of a metallic material and frangibly connected to the anchor member via a breakage point. A loading system is arranged to be positioned on top of the adjacent tiles and includes a drive mechanism. The drive mechanism is connected to the tensioning member and is selectively operable to secure and level the adjacent tiles between the anchor member and the loading system.

U.S. Pat. No. 9,279,259 for a "Tile Lippage Removal System," issued on Mar. 8, 2016 to inventor William P Russo, provides for a tile lippage removal system that includes a spacer post, a threaded cap, and an anti-friction protection plate. The spacer post includes a base member, a spacer member, and a threaded shaft. A bottom of the spacer member extends from a top of the base member. A break away connection is made between the spacer member and the base member. A bottom of the threaded shaft extends from a top of the spacer member. A plurality of grip extensions extends from an outer surface of a substantial inverted cup to allow rotation of the threaded cap. A female thread is formed in a center of the substantial inverted cup to threadably receive the threaded shaft. The anti-friction protection plate includes a round outer perimeter and a spacer opening, which is sized to receive the spacer member. The anti-friction protection plate may be used to improve existing tile lippage removal systems.

U.S. Pat. No. 9,470,002 for a "Tile Leveller and Spacing System," issued on Oct. 18, 2016 to assignee ME INNOVATIONS PTY LTD, provides for a tile leveller and spacer system that allows rapid and reliable spacing and levelling of tiles. The tile spacer comprises a base for locating the spacer under the tiles, and a stem that includes an alignment cross which is used to correctly space the tiles. The stem tile spacer is placed over the stem and engages with teeth on the stem. The tile leveller is pushed down over the stem to level the tiles between the base and the bottom of the tile leveller. The stem further comprises a frangible portion located between the base and the tile alignment portion, and when the stem is pulled with sufficient force, the frangible portion breaks to allow removal of the stem. A hand tool may be used to assist in this process. The hand tool can have an adjustable stop which can be set to a first setting to level the tiles, and a second setting to cause the frangible portion to break, allowing removal of the stem and leveller.

US Publication No. 2018/0355623 for a "Tile Leveling System," published on Dec. 13, 2018 by inventor Scott Frisco, discloses a tile leveling system for leveling tiles. The system has a tile lifter whose transverse member is inserted into the grout gap, and turned to get underneath adjacent tiles. The system has a reusable clamping unit, a U-shaped, possibly flexible, wedge, which is slid through the lifter's vertical shaft to sandwich the tiles between the transverse member and the wedge. The transverse member can be concave up, and the lifter can have two transverse members with spacers on each four-corner junction. The lifter's handle can have a U-shaped hole, which allows a rocker tool to be used to level tiles. Another leveling tool, called a gun tool can be used with any of the lifters. Also proposed are two simpler threaded and zip-tie systems. The leveling devices can be used as needed, thus saving the cost of using them in the entire tiled area.

U.S. Pat. No. 8,429,878 for a "System and Method for Aligning and Leveling Tile," issued on Apr. 30, 2013 to assignee New Standards Manufacturing Co., provides for a tile aligning and leveling system that uses an under tile base, a re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

U.S. Pat. No. 8,820,031 for a "Tile Alignment and Leveling Device," issued on Sep. 2, 2014 to assignee Davinci Italia/USA Group, LLC, provides for a tile alignment and leveling device for aligning and leveling tiles as they are being secured to a substrate. The device includes a flexible member, a bottom plate, and an intermediate member. The intermediate member spaces the flexible member and bottom plate a predetermined vertical distance. The flexible member has a first end and a second end. The first end is pivotally combined with the intermediate member thereby allowing the flexible member to pivot between a first position and a second (downward) position. In use and in its second position, the flexible member second end exerts force against the top of the tiles to help align and level the tiles as they are secured to the substrate.

SUMMARY OF THE INVENTION

This invention provides a micropoint structures for tile edge spacing system and method for use with tiles set with mortar as floors or walls on prepared surfaces.

The micropoint structures for tile edge spacing system and method provide spacing tabs having micropoint structures, where the spacing tabs can be used as components of lippage-control units or be used or reused as auxiliary or standalone spacers. Each micropoint structure protrudes from a face of the spacing tab and has a contact area at an extreme point. Each micropoint structure has a corresponding micropoint structure on the opposite face of the spacing tab, and the distance between the contact areas of corresponding micropoint structures controls the spacing of the gap or grout line between the installed tiles. The configuration and placement of the micropoint structures provide proper setting of the gap between tiles at the top edges, avoiding spacing problems caused by irregular tile side surfaces or irregular underlayment, and provide for avoidance of becoming bound or blocked by the set mortar or tiles which could cause difficulty during removal and cause damage to the set tiles. The micropoint structures are provided in several embodiments each having a small contact area at an extreme point and a tapering or decreasing profile away from the contact area.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
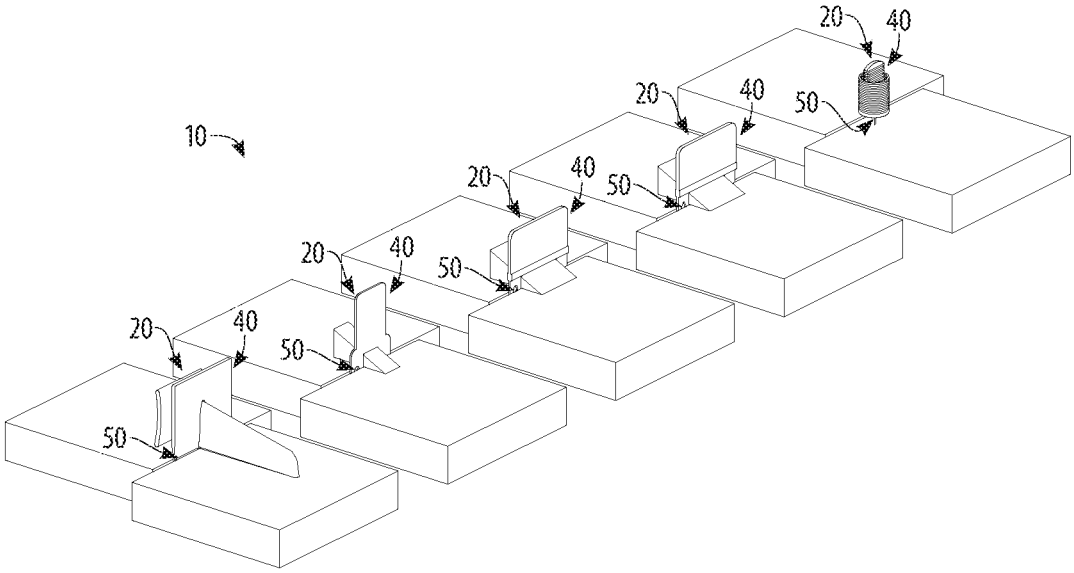
FIG. 1 is a perspective view of the micropoint structures for tile edge spacing system and method of the invention in use.
Figure 2:
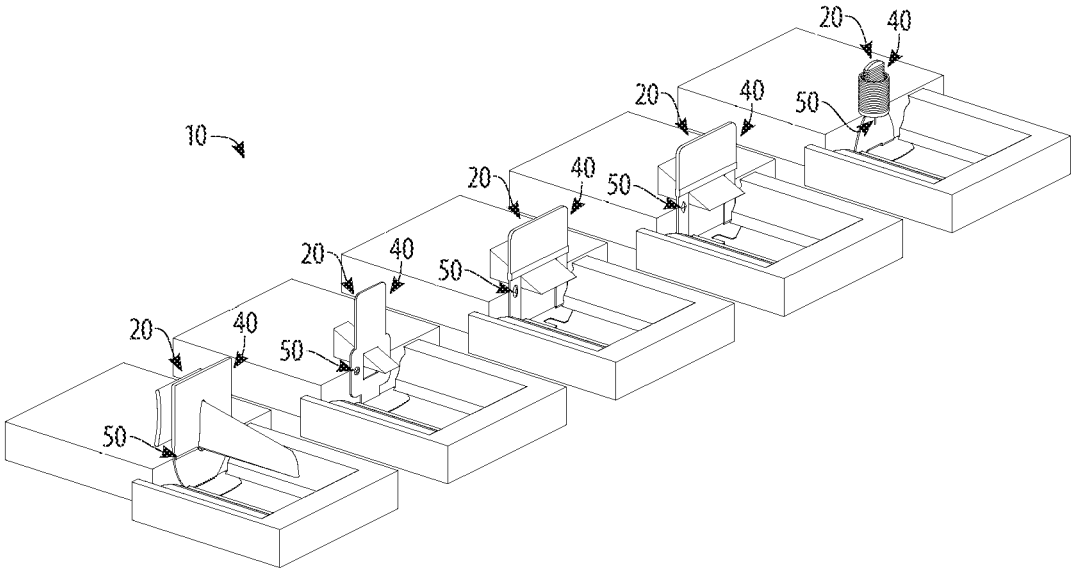
FIG. 2 is a perspective cutaway view of the micropoint structures for tile edge spacing system and method of the invention in use.

Referring to FIG. 1 and FIG. 2, the micropoint structures for tile edge spacing system 10 and method for use with tiles set with mortar as floors or walls on prepared surfaces provides spacing tabs 40 having micropoint structures 50. The spacing tabs 40 can be used as components of lippage-control units 20 or can be used as auxiliary or standalone spacers. Lippage-control units 20 generally have a footplate which is permanently set into the mortar under the tiles. A spacing tab 40 is removably attached to the footplate, and the spacing tab 40 extends up between two adjacent tiles, serving additionally as a spacer between the tiles, to provide for a uniform grout line. At the top level of the tiles a means of clamping, such as the wedges and the threaded nut illustrated, is used to pull the spacing tab 40 and the attached footplate upward, exerting a clamping force at the tops and bottoms of the two adjacent tiles, holding the tops of the tiles level with each other while the mortar sets. After the mortar sets the spacing tabs 40 are detached from the footplates and are removed. This removal should be done without damaging the tiles, such as breaking the edges of the tiles, which would necessitate remedial work. The removed spacing tabs 40, from which the footplates have been removed, can optionally be reused as standalone spacers between tiles, either as auxiliary spacers alongside intact lippage-control units 20, or be used alone when no lippage-control units 20 are required. Usually, gauged tiles or panels or slabs are used and are set with thinset mortar. Usually, a very thin grout line is used, with 1/16" or 0.8 mm being the thinnest allowed by ANSI A108.19.

The spacing tab 40 has two broad faces oriented along the gap or space between the tiles, and facing opposite each other. The micropoint structures 50 are placed on these two faces.

Whether spacing tabs 40 are used as components of lippage-control units 20 or as standalone spacers, it is important that the tab provides the proper thickness of material to hold the tiles at the proper spacing while the mortar sets and also provides for easy, clean, and safe removal, without risking damage to the tiles, after the mortar is set and before grouting. It is also important that the uniform spacing between the tiles be achieved at the top edges of the tiles, which can be difficult to achieve with tiles not having perfect perpendicularity and uniformity of the side faces, or where the underlying surface is not perfectly solid, smooth, and level. Although the proper thickness of material for spacing can be provided by various protrusions, such protrusions might also become stuck or blocked by set mortar making the spacer difficult to remove without damaging the set tiles. Also, where such a protrusion is located away from the top level of the tiles or is too large and extends too far away from the top edges, it becomes more likely that such a protrusion will become stuck or blocked either by mortar or by the side faces of the tiles, especially where the side faces of the tiles have some irregularity.

The spacing tabs 40 can be made of plastic material, including recycled plastic material. High-density polyethylene (HDPE) is a suitable material which has a high strength-to-density ratio, is resistant to solvents and glues, is inherently non-marring, and is widely available as recycled material. The spacing tabs 40 can be manufactured by molding the plastic material, and the micropoint structures 50 can be formed in the molding process.

Figure 3:
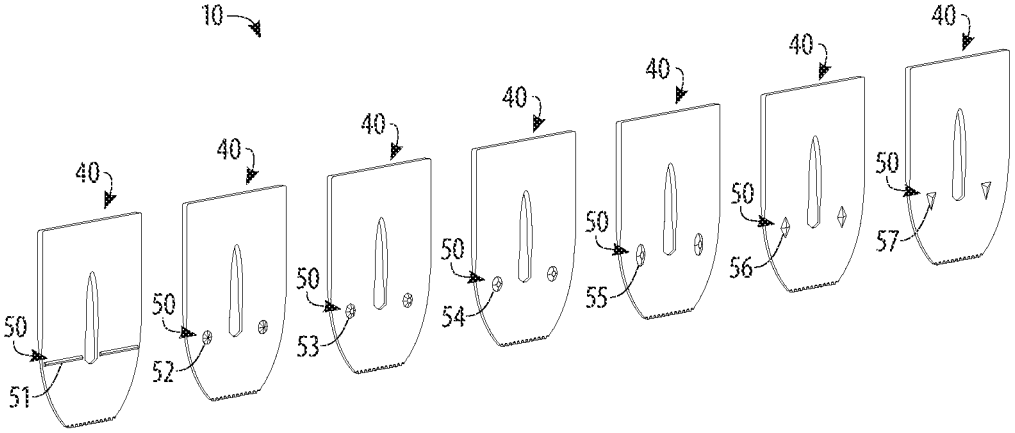
FIG. 3 is a perspective view of various embodiments of the micropoint structures arrayed upon an embodiment of the spacing tab of the micropoint structures for tile edge spacing system and method of the invention.

Referring to FIG. 3, the micropoint structures for tile edge spacing system 10 and method provides spacing tabs 40 having micropoint structures 50 which protrude from a face of the spacing tabs 40 and provide for proper spacing between the top edges of adjacent tiles during installation and while the mortar sets, creating the proper space for uniform grout lines, while avoiding improper spacing caused by contact with other possibly inconsistent or aberrant portions of the tile side faces, and avoiding becoming bound, stuck, or blocked by set mortar. Embodiments having various specific configurations of micropoint structures 50 are illustrated: half-cylinder microstructure 51, cone microstructure 52, dodecahedron microstructure 53, dome microstructure 54, ellipsoid microstructure 55, octahedron microstructure 56, and tetrahedron microstructure 57. At least one micropoint structure 50 on each of the two opposite faces of the spacing tab 40 is required, as illustrated below in FIG. 12 and FIG. 13. Two micropoint structures per face, for a total of four, can also be used, as shown.

Each micropoint structure 50 on one face of a spacing tab 40 has an exactly corresponding micropoint structure 50 on the opposite face of the tab. The extreme point of the micropoint structure 50 is the contact area which the tile will be placed against during installation. When two tiles are placed against the contact areas of opposite-facing corresponding micropoint structures 50 the two tiles are placed at a preset fixed distance, leaving a gap to be filled with a grout or similar material. The total spacing distance of a spacing tab 40 with micropoint structures 50 is the distance from the contact area at the extreme point of one micropoint structure 50 through the spacing tab 40 to the contact area at the extreme point of the corresponding opposite facing micropoint structure 50. This distance will typically be at least 1/16" or 1.59 mm as required by ANSI A108.19, or 1/8" or 3.18 mm. Larger spacings are sometimes used. The size of the contact area at the extreme point of the micropoint structure 50 is very small in relation to the size of the spacing tab 40 and the width of the gap or grout line. Embodiments of the micropoint structures 50 are shown which have contact areas configured as single points, as ridges, or as small substantially flat areas. For embodiments having small substantially flat contact areas, preferred embodiments have contact areas not substantially greater than 3 square millimeters or 0.005 square inches. The thickest portions of the spacing tabs 40 below the tops of the tiles are the relatively small columns of material between two opposing contact areas, which set the spacing of the gap or grout line. If the plastic material used does not have sufficient stability and resistance to compressive force, then the relatively small columns of material might not adequately hold the intended spacing against shifting of the tiles before the mortar is fully set. HDPE material does have adequate resistance to compressive force, but does compress a small amount. An extra thickness from 1/32" to 1/64" over the desired spacing can be added during manufacture to compensate for the slight compression.

An advantage of the relatively small contact areas at the extreme points of the micropoint structures 50 is that during use installing tile if any mortar were to be mistakenly applied to the contact area or to the portion of the side of the tile in contact with the contact area, the misapplied mortar will be pushed aside by the micropoint at the apex of the micropoint structure 50 and will not become trapped between the contact area and the side of the tile, which would increase the size of the gap between the tiles.

Other advantages of the relatively small contact areas at the extreme points of the micropoint structures 50, and the sloping, tapering, or decreasing profile away from the contact area are that the micropoint structures 50 are less likely to become bound or blocked by misapplied mortar and are more easily pulled free from set mortar, and any squeezing or clamping pressure exerted on the spacing tab 40 by the sides of the set tiles will only be exerted on the small contact areas, providing for easy and safe removal without damage. Where HDPE or a material with similar properties is used, the low-friction surface and the ability to temporarily deform slightly to accommodate stress forces also promote easy and safe removal.

Figure 4:
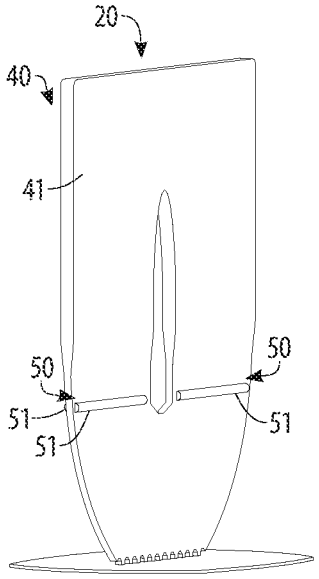
FIG. 4 is a perspective view of a first embodiment of the spacing tab with a first embodiment of the micropoint structures of the micropoint structures for tile edge spacing system and method of the invention.
Figure 5:
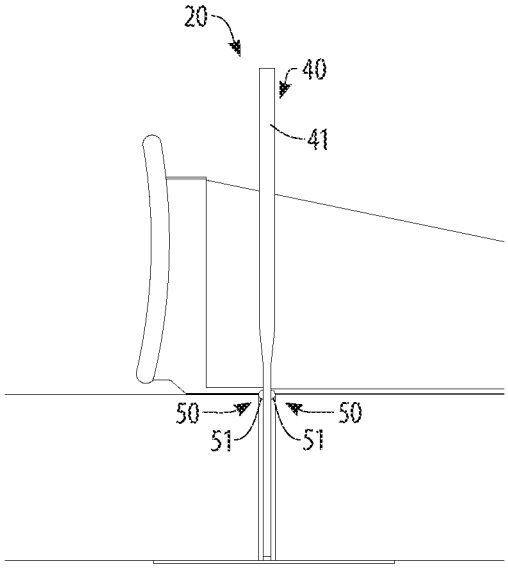
FIG. 5 is a side view of a first embodiment of the spacing tab with a first embodiment of the micropoint structures of the micropoint structures for tile edge spacing system and method of the invention.

Referring to FIG. 4 and FIG. 5, an embodiment of a lippage-control unit 20 and spacing tab 40 of a first-type tab 41, with micropoint structures 50 having a half-cylinder microstructure 51 configuration is shown in use.

Figure 6:
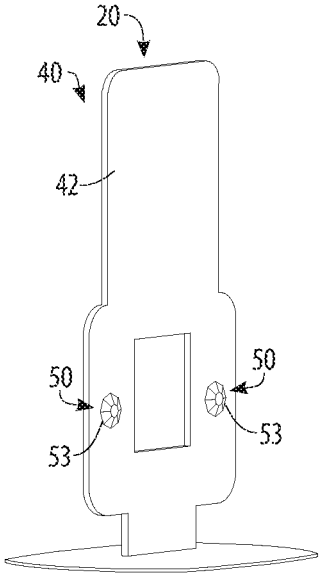
FIG. 6 is a perspective view of a second embodiment of the spacing tab with a third embodiment of the micropoint structures of the micropoint structures for tile edge spacing system and method of the invention.
Figure 7:
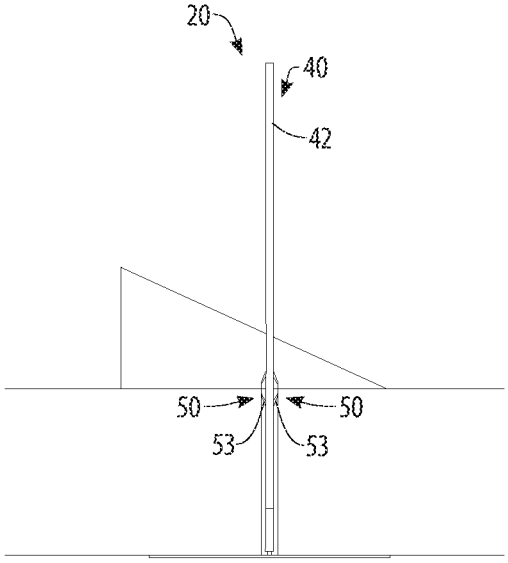
FIG. 7 is a side view of a second embodiment of the spacing tab with a third embodiment of the micropoint structures of the micropoint structures for tile edge spacing system and method of the invention.

Referring to FIG. 6 and FIG. 7, an embodiment of a lippage-control unit 20 and spacing tab 40 of a second-type tab 42, with micropoint structures 50 having a dodecahedron microstructure 53 configuration is shown in use.

Figure 8:
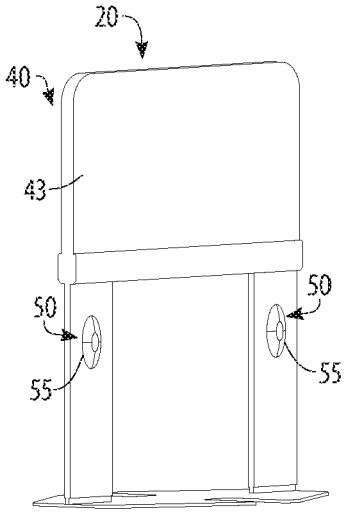
FIG. 8 is a perspective view of a third embodiment of the spacing tab with a fifth embodiment of the micropoint structures of the micropoint structures for tile edge spacing system and method of the invention.
Figure 9:
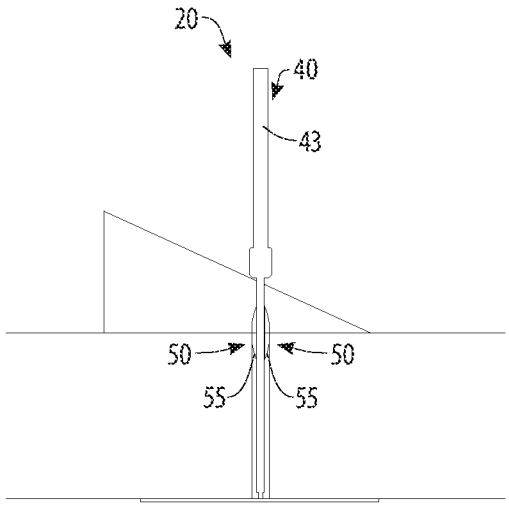
FIG. 9 is a side view of a third embodiment of the spacing tab with a fifth embodiment of the micropoint structures of the micropoint structures for tile edge spacing system and method of the invention.

Referring to FIG. 8 and FIG. 9, an embodiment of a lippage-control unit 20 and spacing tab 40 of a third-type tab 43, with micropoint structures 50 having an ellipsoid microstructure 55 configuration is shown in use.

Figure 10:
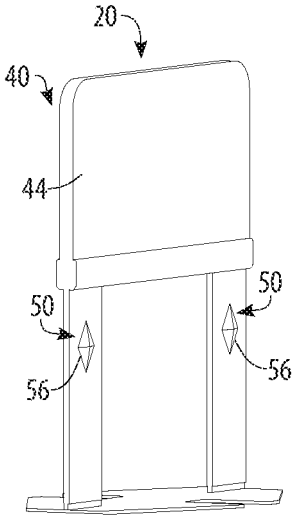
FIG. 10 is a perspective view of a fourth embodiment of the spacing tab with a sixth embodiment of the micropoint structures of the micropoint structures for tile edge spacing system and method of the invention.
Figure 11:
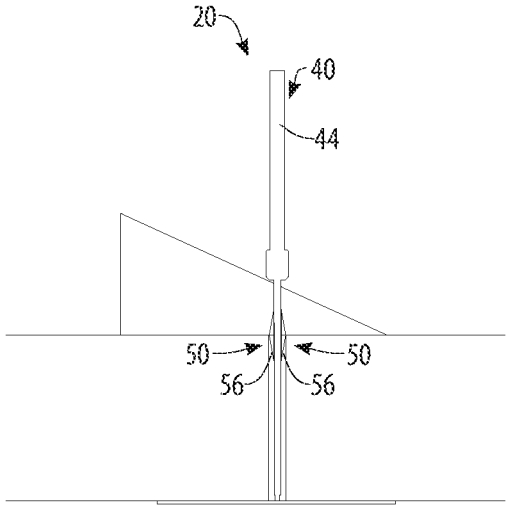
FIG. 11 is a side view of a fourth embodiment of the spacing tab with a sixth embodiment of the micropoint structures of the micropoint structures for tile edge spacing system and method of the invention.

Referring to FIG. 10 and FIG. 11, an embodiment of a lippage-control unit 20 and spacing tab 40 of a fourth-type tab 44, with micropoint structures 50 having an octahedron microstructure 56 configuration is shown in use.

Figure 12:
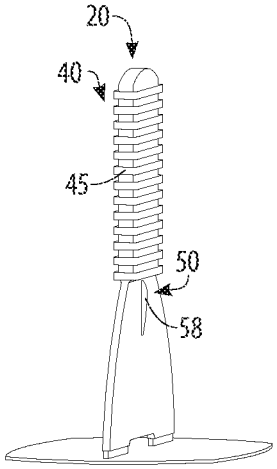
FIG. 12 is a perspective view of a fifth embodiment of the spacing tab with an eighth embodiment of the micropoint structures of the micropoint structures for tile edge spacing system and method of the invention.
Figure 13:
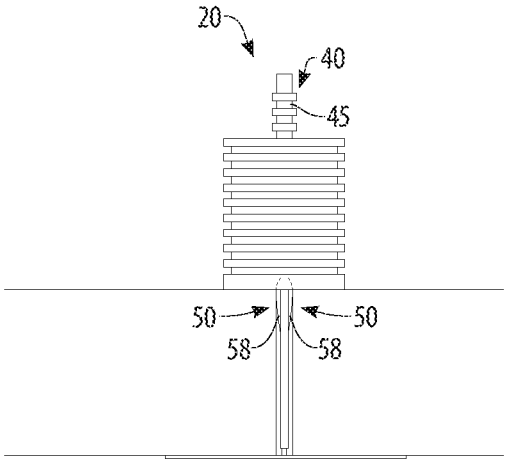
FIG. 13 is a side view of a fifth embodiment of the spacing tab with an eighth embodiment of the micropoint structures of the micropoint structures for tile edge spacing system and method of the invention.

Referring to FIG. 12 and FIG. 13, an embodiment of a lippage-control unit 20 and spacing tab 40 of a fifth-type tab 45, with micropoint structures 50 having a fin microstructure 58 configuration is shown in use. This embodiment illustrates that a single micropoint structure 50 on each face of the spacing tab 40, paired with a corresponding micropoint structure 50 on the opposite face, can be used.

Many other changes and modifications can be made in the system and method of the present invention without departing from the spirit thereof. We therefore pray that our rights to the present invention be limited only by the scope of the appended claims.

We claim:

1. A micropoint structure system for tile edge spacing system for use with tiles set with mortar as floors or walls on prepared surfaces, the micropoint structures for tile edge spacing system comprising:

(i) a spacing tab configured to be positioned between adjacent tile edges to set a spacing between tiles, the spacing tab having two opposing faces oriented along the gap between tiles; and (ii) at least two micropoint structures, each adapted to protrude from and transversely to a face of said spacing tab, each micropoint structure terminating in a tile-contacting extreme point configured to contact only an edge surface of a respective tile, and each micropoint structure having a decreasing profile away from said extreme point;

where at least one said micropoint structure protrudes from a first face of said spacing tab, and an additional said micropoint structure protrudes from a second face of said spacing tab at a location corresponding to and opposite each said micropoint structure protruding from the first face of said spacing tab; and where the distance between said extreme point of each corresponding and opposing pair of said micropoint structures defines a spacing distance between tiles.

2. The micropoint structures for tile edge spacing system of claim 1, where said spacing tab further comprises a component of a lippage-control unit.

3. The micropoint structures for tile edge spacing system of claim 1, where said spacing tab is further made of a plastic material.

4. The micropoint structures for tile edge spacing system of claim 1, where said spacing tab is further made of a recyclable plastic material.

5. The micropoint structures for tile edge spacing system of claim 1, where said spacing tab is further made of high-density polyethelene.

6. The micropoint structures for tile edge spacing system of claim 1, where said spacing tab is further adapted for re-use as a spacer in later tile installations.

7. The micropoint structures for tile edge spacing system of claim 1, where said small contact area is not larger than three square millimeters.

8. The micropoint structures for tile edge spacing system of claim 1, where said small contact area is not larger than 0.005 square inches.

9. A micropoint structure system for tile edge spacing for use with tiles set with mortar as floors or walls on prepared surfaces, the micropoint structure system for tile edge spacing comprising:

(i) a lippage-control unit adapted to hold the top edges of adjacent tiles level with each other and to set the spacing between adjacent tile edges during installation and setting of the mortar, having a spacing tab having two opposing faces oriented along the gap between tiles; and (ii) at least two micropoint structures, each adapted to protrude from and transversely to a respective face of said spacing tab, each micropoint structure terminating in a tile-edge-contacting extreme point, the micropoint structures on the first and second faces being axially aligned such that the tile-spacing distance is defined solely by the distance between the extreme points, each micropoint structure having a decreasing profile away from said extreme point.

10. A micropoint for tile edge spacing method comprising the steps of:

(i) providing a micropoint for tile edge spacing system comprising:

(a) a spacing tab configured to be positioned between adjacent tile edges, the spacing tab having first and second opposing faces oriented along a grout gap; and (b) at least two micropoint structures, each protruding outwardly from and transversely to, a respective one of the opposing faces of the spacing tab, each micropoint structure terminating in a tile-edge-contacting extreme point and having a decreasing profile away from said extreme point;

wherein each micropoint structure on the first face is axially aligned with a corresponding micropoint structure on the second face; and where a spacing distance between the edges of adjacent tiles is defined solely by the distance between the extreme points of each corresponding pair of opposing micropoint structures;

(ii) applying mortar to the prepared surface;

(iii) placing said spacing tab between two adjacent tiles such that the extreme points of the micropoint structures contact the tile edges;

(iv) allowing curing and setting of the mortar;

(v) removing said spacing tab from the grout joint; and (vi) grouting the grout joint.

11. A tile edge spacing system for use with tiles set with mortar, comprising:

(i) a spacing tab configured to be positioned between adjacent tile edges during installation, the spacing tab having first and second opposing faces oriented along a grout gap between the tiles; and (ii) a plurality of micropoint structures, each micropoint structure protruding outwardly from and transversely to a respective one of the opposing faces of the spacing tab, each micropoint structure terminating in a tile-edge-contacting extreme point;

wherein each micropoint structure on the first face is axially aligned with a corresponding micropoint structure on the second face, such that a spacing distance between the tiles is defined solely by the distance between the extreme points of each corresponding pair of opposing micropoint structures.

* * * * *